US008096161B2

(12) United States Patent
Baumgärtel et al.

(10) Patent No.: US 8,096,161 B2
(45) Date of Patent: Jan. 17, 2012

(54) METHOD FOR ROLLING STRIPS IN A ROLL STAND

(75) Inventors: Uwe Baumgärtel, Hilchenbach (DE); Ralf Wachsmann, Siegen (DE); Jürgen Seidel, Kreuztal (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 735 days.

(21) Appl. No.: 11/630,935

(22) PCT Filed: Jun. 3, 2005

(86) PCT No.: PCT/EP2005/005991

§ 371 (c)(1),
(2), (4) Date: Dec. 27, 2006

(87) PCT Pub. No.: WO2006/000290

PCT Pub. Date: Jan. 5, 2006

(65) Prior Publication Data

US 2007/0199363 A1 Aug. 30, 2007

(30) Foreign Application Priority Data

Jun. 28, 2004 (DE) ..... 10 2004 031 354

(51) Int. Cl.

| | |
|---|---|
| ***B21B 31/18*** | (2006.01) |
| ***B21B 37/24*** | (2006.01) |
| ***B21B 29/00*** | (2006.01) |
| ***B21B 23/00*** | (2006.01) |

(52) U.S. Cl. ..... 72/247; 72/7.1; 72/241.8; 72/366.2

(58) Field of Classification Search ..... 72/247, 72/241.8, 7.1, 7.4, 7.6, 365.2, 366.2; 700/154
See application file for complete search history.

(56) References Cited

U.S. PATENT DOCUMENTS 5,655,397 A 8/1997 Satoh et al.
6,119,500 A * 9/2000 Ginzburg et al. ..... 72/247

FOREIGN PATENT DOCUMENTS

EP 0276743 8/1988

(Continued)

OTHER PUBLICATIONS

Patent Abstracts of Japan, vol. 018, No. 217 (M-1594), Apr. 19, 1994 & JP 06 015322 A (Sumitomo Metal Ind Ltd), Jan. 25, 1994.
Patent Abstracts of Japan, vol. 012, No. 292 (M-729), Aug. 10, 1988 & JP 63 068201 A (Kawasaki Heavy Ind Ltd), Mar. 28, 1988.

*Primary Examiner* — Edward Tolan
*Assistant Examiner* — Mohammad Ibrahim Yusuf
(74) *Attorney, Agent, or Firm* — Lucas & Mercanti, LLP; Klaus P. Stoffel

(57) ABSTRACT

The invention relates to a method for rolling strips in the roll stand of a rolling mill, wherein said roll stand consists of two axially displaceable working rollers which are provided with a CVC-grinding or a similar contour and whose curved profile is expressed in a third or higher-order polynom and, simultaneously with simple handling of working rollers with large possibilities of adjusting the profile and flatness, the aim of said invention is to homogenize the working rollers wear. For this purpose, the increased cyclic shifting of the working rollers is induced or forced by a cyclic variation of the setting values of the curve of the working cylinders from one strip to another in a predetermined part of the adjustment range thereof, wherein the combined the action of the two adjustment systems (the curve of the working cylinders and the shift thereof) enables the parabolic effects of said two adjustment systems to supplement each other with a high approximation, thereby ensuring the flatness and, in addition, optimally homogenizing the working roller wear.

6 Claims, 3 Drawing Sheets

FOREIGN PATENT DOCUMENTS

| | | |
|---|---|---|
| EP | 1 055 464 | 11/2000 |
| RU | 2203154 | 4/2003 |
| SU | 1362514 | 12/1987 |
| SU | 1452631 | 1/1989 |

* cited by examiner

METHOD FOR ROLLING STRIPS IN A ROLL STAND

The invention concerns a method for rolling strip in a rolling stand of a rolling train, which rolling stand consists of two axially shiftable work rolls, which are provided with a CVC cross section or similar contour, whose curved contour can be expressed by a polynomial of third or higher order; of two backup rolls and possibly two additional intermediate rolls; and of a work roll bending system and possibly an additional intermediate roll bending system, wherein the work roll bending or the work roll shifting is used from case to case as an adjusting mechanism to control the strip flatness and the strip profile. Alternatively or additionally, intermediate roll bending and intermediate roll shifting can be used in the same way as work roll bending.

When conventional rolls are used, strip flatness is adjusted by suitable choice of a work roll crown (positive, negative, or cylindrical) and suitable choice of work roll bending. Therefore, a disadvantage here is that different work roll crowns must be used in different rolling programs, which makes work roll handling difficult. Furthermore, work roll bending often reaches its adjustment limit with complicated rolling programs and thus can no longer ensure flatness.

The use of work rolls with a CVC contour (CVC=continuously variable crown), even in the rear stands of a rolling train, has been found to be an effective means of simplifying work roll handling and at the same time having a positive effect on the profile and the flatness.

Work roll bending then seldom reaches its limits of adjustment and is available for dynamic control. A disadvantage here is that, with conventional shifting practice of the CVC work rolls, the shifting range that is used within a rolling program comes out relatively small, and work roll wear is evened out only to a limited extent. Therefore, a flat CVC cross section is used as a compromise, i.e., a reduced CVC adjustment range at a suitable shifting stroke.

Proceeding on the basis of this prior art, the objective of the invention is to specify a method for rolling strip in a rolling stand with axially shiftable CVC work rolls or work rolls with a similar contour, which allows both simple roll handling and large profile and flatness adjustment and at the same time makes it possible to achieve uniform work roll wear.

This objective is achieved with the features of Claim 1 in such a way that cyclic variation of the work roll bending from strip to strip in a well-defined predetermined part of its adjustment range induces or forces increased cyclic shifting of the work rolls in order to adjust the strip flatness and the body strip profile, wherein the combined action of the two adjustment systems (work roll bending and work roll shifting) allows the very nearly parabolic effects of the two adjustment systems to complement each other, thereby ensuring flatness as well as optimum uniformity of work roll wear.

Advantageous refinements of the invention are specified in the dependent claims.

The cyclic shifting of work rolls in itself is already well known. However, this mode of operation has been previously practiced only with rolls with a conventionally cambered work roll cross section, especially in the rear stands of a rolling train (Hitachi Review, Vol. 34, No. 4, pp. 153-167, 1985) or in exceptional cases with tapered rolls in a limited range (EP 0 153 849 A2).

The cyclic variation, in accordance with the invention, of the work roll bending in CVC rolls, which have a relatively large parabolic profile adjustment range, has never been practiced before and is novel. This cyclic variation of the work roll bending, which can be assisted by the rolling force or by the rolling force distribution within the rolling train, initiates, in the case of CVC rolls, additional cyclic shifting of the work rolls and at the same time results in uniform work roll wear.

The large parabolic profile adjustment range of the CVC work rolls remains available at all times, so that it is possible to react to altered boundary conditions, such as backup roll wear, thermal crown, rolling force, rolling stand loading, etc. Depending on these boundary conditions, the cyclic shifting of the work rolls is then preferably carried out either in the positive or negative shift adjustment range or in the total shift adjustment range.

In accordance with the invention, the cyclic shifting of the work rolls is directly preset or is indirectly forced by the cyclic variation of the work roll bending, wherein the interaction between the work roll shifting and the work roll bending is controlled online by a process model.

In this connection, the cyclic variation of the work roll positions or work roll bending is carried out only in the permissible range, in which the strip quality parameters, such as flatness (parabolic and higher order), strip contour quality, and strip profile level, can be fulfilled, wherein to maintain these criteria, the cyclic shifting stroke and/or the preset range for the work roll bending can then be limited by the process model (i.e., monitored online).

Since in the case of the first incoming strips after, for example, a roll change, automatically larger shift position changes are to be expected during the adjustment of profile and flatness that then becomes necessary, the cyclic variation of the work rolls is activated either immediately after a roll change or shortly thereafter, for example, after the first five strips.

Alternatively, depending on the design of the rolling stand, instead of or as a supplement to the cyclic variation of the work roll bending, it is possible to use intermediate roll bending or intermediate roll shifting or to use a backup roll profile adjusting mechanism in analogous fashion in order to produce cyclic variation of the work roll positions.

Further details, features, and advantages of the invention are explained in greater detail below with reference to the specific embodiments of the invention shown schematically in the figures.

In the illustrated examples, the two simulated operating modes of work roll shifting and work roll bending are shown for different shifting with the example of a rolling program of 85 strips (coils). In FIGS. 1 to 10, the number of strips (number of coils) or the consecutive strip number is plotted on the x-axis.

Figure 1:
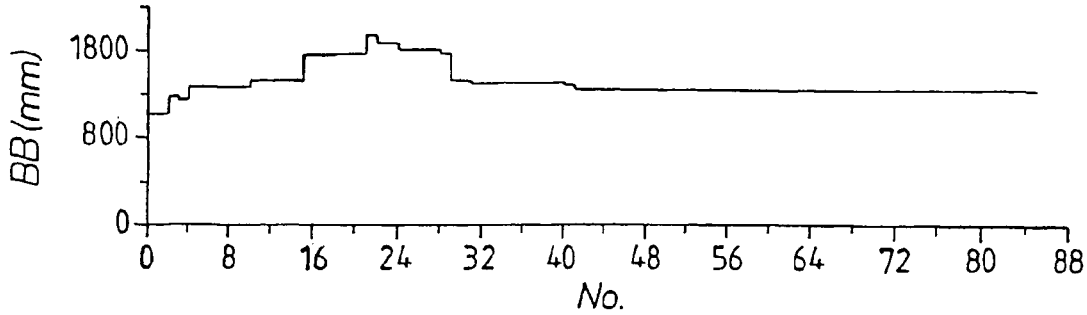
FIG. 1 shows a strip width rolling program for 85 strips.
Figure 2:
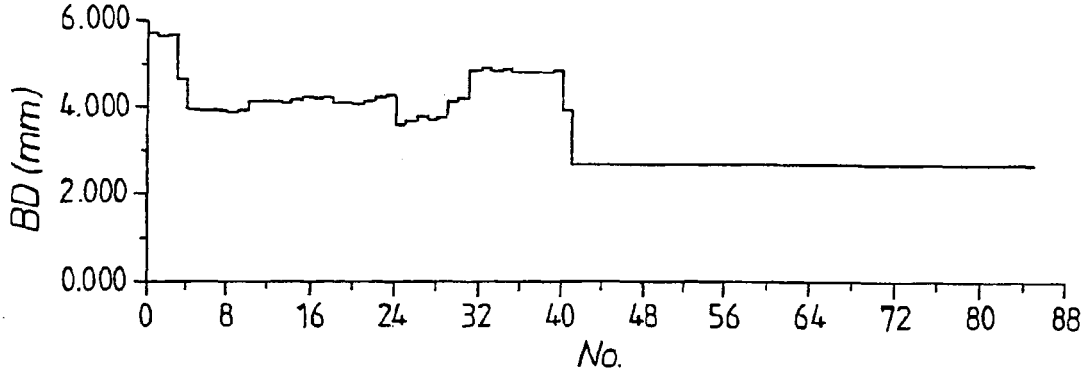
FIG. 2 shows a finished strip thickness rolling program for 85 strips.

In FIG. 1, the strip widths BB to be rolled according to the rolling program are plotted in mm on the y-axis, and in FIG. 2, the finished strip thicknesses BD are plotted in mm on the y-axis. Up to about strip No. 40, different strip widths BB and finished strip thicknesses BD are rolled, and then strips with a constant strip width of about 1,200 mm and a constant finished strip thickness BD of about 2.8 mm are produced.

In FIGS. 3 to 6, the results to be expected for conventional shifting of the CVC work rolls with different rolling stand loading or different backup roll wear are plotted for the rolling program shown in FIGS. 1 and 2.

Figure 3:
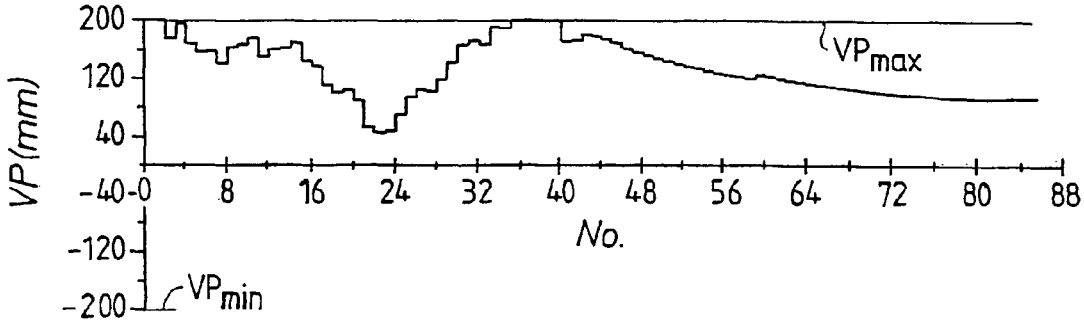
FIGS. 3 and 4 show conventional shifting with high stand loading.
Figure 4:
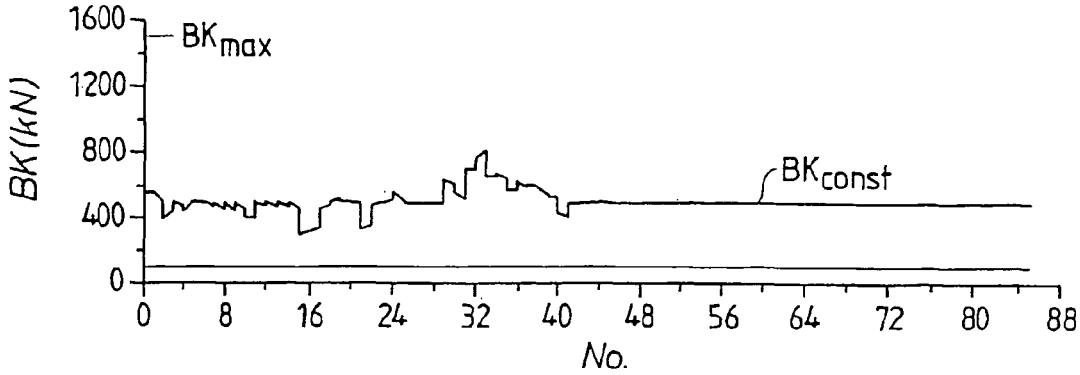

FIGS. 3 and 4 show the results obtained for the necessary work roll shift position VP in mm (FIG. 3) and the applied work roll bending force BK in kN (FIG. 4) for high backup roll wear or high stand loading. As FIG. 3 shows, in this conventional operating mode, the work roll positions are adjusted mainly in the positive range in order, for example, to compensate the loading of the stands in this way. The maximum shift limit $VP_{max}$ is reached in some cases.

Figure 5:
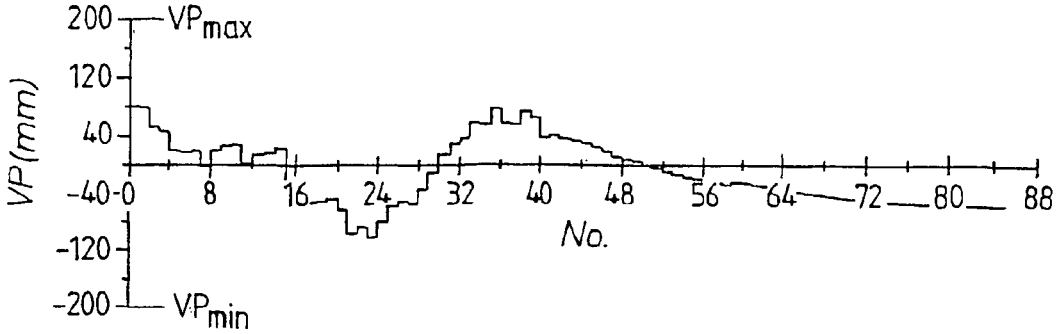
FIGS. 5 and 6 show conventional shifting with low stand loading
Figure 6:
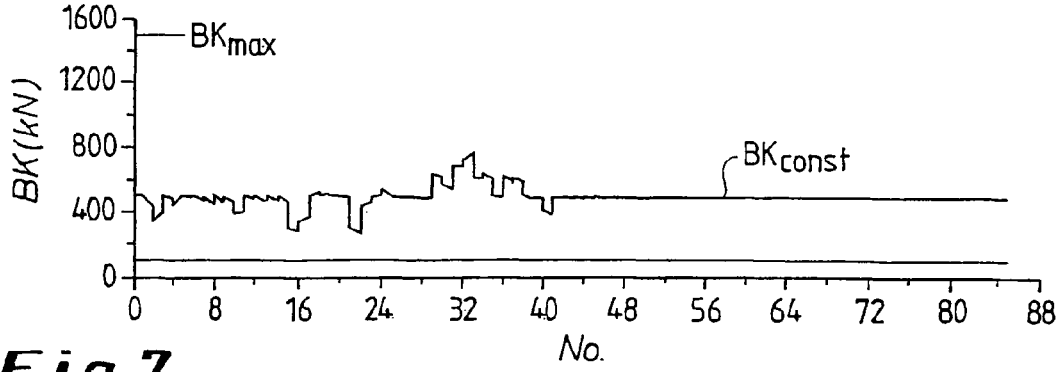

FIGS. 5 and 6 are similar to FIGS. 3 and 4 and show the corresponding results obtained for low backup roll wear or low stand loading. The curves obtained for the work roll shift position VP (FIG. 5) and for the work roll bending force BK (FIG. 6) resemble those of FIGS. 3 and 4 in their characteristic properties, but at approximately the same bending force, the work roll shift values VP—corresponding to the changed boundary condition—are now operated more in the middle shift adjustment range. A common feature is that, in conventional shifting practice of the CVC work rolls viewed as a whole, the shift amount is relatively small, and the work roll bending force BK becomes constant ($BK_{const}$) after about the 40th strip in accordance with the rolling program.

The results to be expected, in accordance with the invention, for the cyclic shifting of the CVC work rolls and work roll bending at different stand loading or different backup roll wear are plotted in FIGS. 7 to 10 for the same rolling program.

Figure 7:
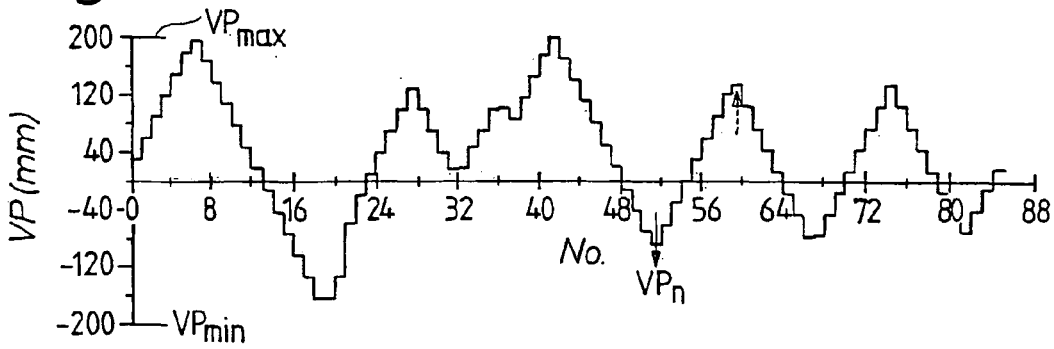
FIGS. 7 and 8 show cyclic shifting with high stand loading.
Figure 8:
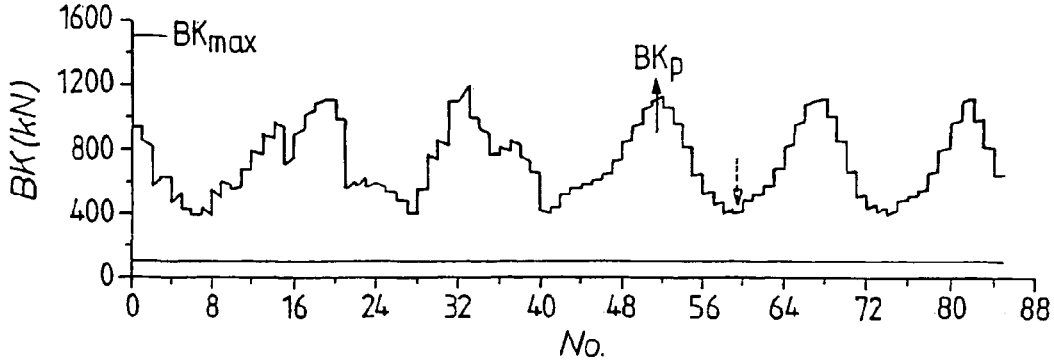

FIGS. 7 and 8 show the results obtained for the work roll shift position VP in mm (FIG. 7) and the applied work roll bending force BK in kN (FIG. 8) for high backup roll wear or high stand loading. A distinct difference from the results of the conventional shifting shown in FIG. 3 is the large adjustment range of the CVC work rolls that is utilized, wherein the rolls are operated in both the positive and the negative range.

Figure 9:
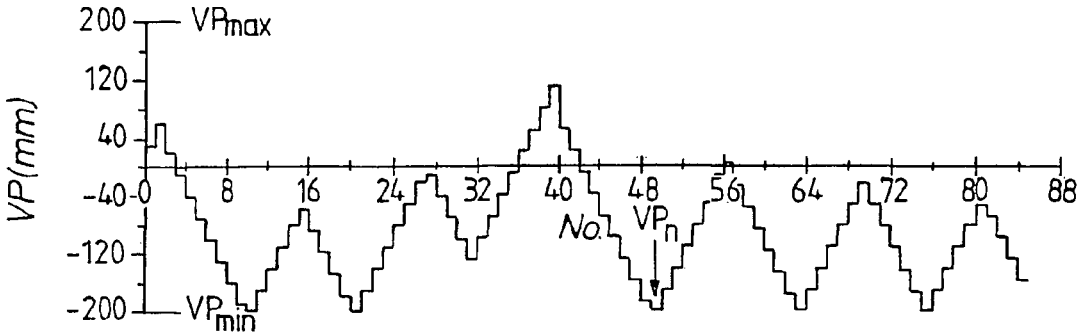
FIGS. 9 and 10 show cyclic shifting with low stand loading.
Figure 10:
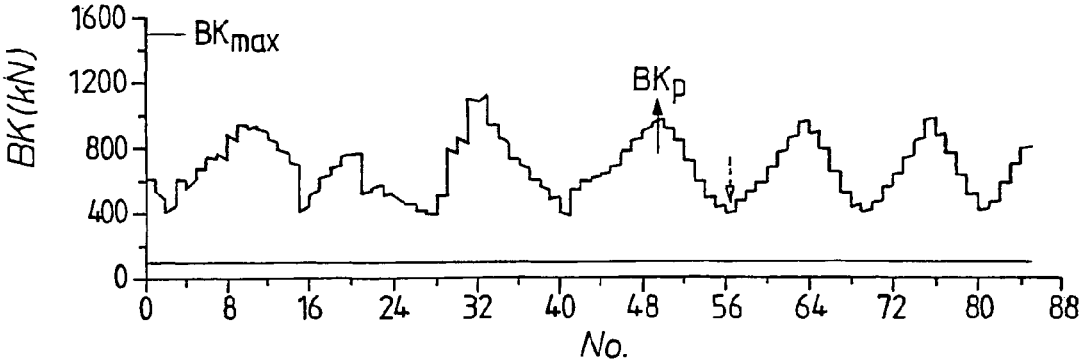

FIGS. 9 and 10 are similar to FIGS. 7 and 8 and show the corresponding results obtained for low backup roll wear or low stand loading. The curves obtained for the work roll shift position VP (FIG. 9) and for the work roll bending force BK (FIG. 10) again resemble those of FIGS. 7 and 8 in their characteristic properties, but at approximately the same bending force, cyclic shifting of the work rolls now takes place more in the negative shift adjustment range in line with the changed boundary condition.

A characteristic feature of the mode of operation of cyclic shifting in accordance with the invention is the oppositely directed interaction between the work roll shift position VP and the work roll bending force BK, which is clearly shown in the drawings. When the CVC work rolls shift in the negative direction $VP_n$, bending occurs in the positive direction $BK_p$ and vice versa.

Figure 11:
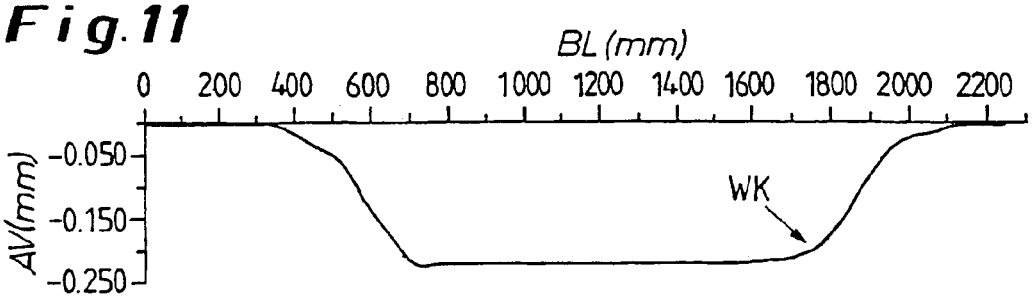
FIG. 11 shows work roll wear contour with cyclic shifting.
Figure 12:
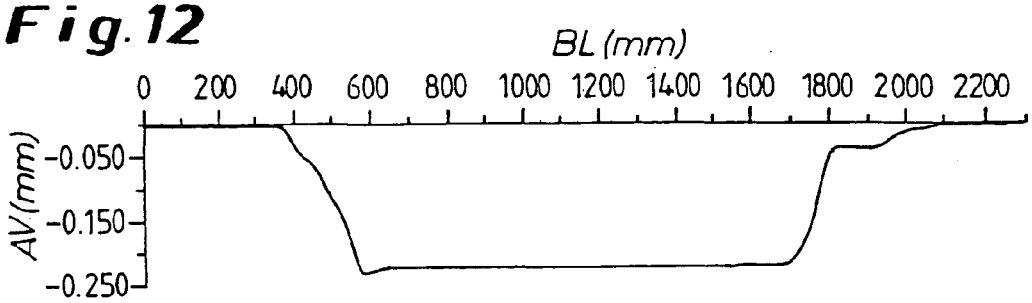
FIG. 12 shows work roll wear contour with conventional shifting.

The uniformity of work roll wear achieved by the cyclic shifting of the CVC work rolls is apparent from FIGS. 11 and 12, in which the work roll wear AV in mm that develops by the end of the rolling program is plotted over the work roll barrel length BL in mm. At approximately the same amount of wear in the middle of the barrel, the roll contour WK in the cyclic mode of operation (FIG. 11) has a more harmonious shape in the edge region compared to the conventional mode of operation (FIG. 12), while a steeper wear flank with a more angular transition is seen in the conventional mode of operation due to the smaller shift.

A more harmonious work roll wear contour has a positive effect on the quality of the strip contour. The development of strip bulges or increased strip edge drop can thus be compensated more efficiently.

LIST OF REFERENCE SYMBOLS

AV work roll wear
BB strip width
BD finished strip thickness
BK work roll bending force
$BK_{const}$ constant bending force
$BK_{max}$ maximum bending force
$BK_p$ bending in the positive direction
BL work roll barrel length
No. coil number
VP work roll shift position
$VP_{max}$ maximum shift limit
$VP_{min}$ minimum shift limit
$VP_n$ shifting in the negative direction
$VP_p$ shifting in the positive direction
WK work roll contour

The invention claimed is:

1. Method for rolling strip in a rolling stand of a rolling train, wherein the rolling stand consists of: two axially shiftable work rolls that are provided with a CVC cross section or similar contour, the curved contour being expressed by a polynomial of third or higher order; two backup rolls and two additional intermediate rolls; and a work roll bending system and an additional intermediate roll bending system, wherein work roll bending or work roll shifting is used from case to case as an adjusting mechanism to control strip flatness and strip profile, wherein cyclic variation of the work roll bending from strip to strip in a well-defined predetermined part of an adjustment range of the bending simultaneously induces or forces increased cyclic shifting of the work rolls in order to adjust the strip flatness and the body strip profile, wherein a combined action of both adjustment systems (work roll bending and work roll shifting) causes very nearly parabolic effects of both adjustment systems to complement each other, thereby ensuring flatness as well as optimum uniformity of work roll wear, wherein interaction between the work roll shifting and the work roll bending is controlled online by a process model, and wherein the cyclic variation of work roll positions or work roll bending is carried out only in a permissible range so that strip quality parameters, including flatness (parabolic and higher order), strip contour quality, and strip profile level, are fulfilled, wherein to maintain the parameters, a cyclic shifting stroke and/or a preset range for the work roll bending is limited by the process model (monitored online), wherein the cyclic shifting of the work rolls is indirectly forced by the cyclic variation of the work roll bending.

2. Method in accordance with claim 1, wherein, depending on boundary conditions, the cyclic shifting of the work rolls is carried out either in a positive or negative shift adjustment range or in a total shift adjustment range.

3. Method in accordance with claim 1, wherein the cyclic shifting of the work rolls is directly preset or is indirectly forced by the cyclic variation of the work roll bending.

4. Method in accordance with claim 1, wherein the work roll bending is assisted by cyclic variation of the rolling force or rolling force distribution within the rolling train.

5. Method in accordance with claim 1, wherein alternatively, depending on design of the rolling stand, instead of or as a supplement to the cyclic variation of the work roll bending, intermediate roll bending or intermediate roll shifting is used or a backup roll profile adjusting mechanism is used in analogous fashion in order to produce cyclic variation of the work roll positions.

6. Method in accordance with claim 1, wherein the cyclic variation of the work rolls is activated immediately after a roll change or shortly thereafter, since in case of first incoming strips, automatically larger shift position changes are to be expected during adjustment of profile and flatness.

* * * * *